United States Patent [19]

Lambert

[11] 4,359,628

[45] Nov. 16, 1982

[54] NAVIGATIONAL AID

[76] Inventor: Leon W. Lambert, 42A Belmore St., Dundas, Sydney, New South Wales, Australia, 2117

[21] Appl. No.: 190,440

[22] Filed: Sep. 24, 1980

[30] Foreign Application Priority Data

Oct. 11, 1979 [AU] Australia ..... PE0892

[51] Int. Cl.[3] ..... G06G 1/08

[52] U.S. Cl. ..... 235/61 NV; 235/78 N; 33/431

[58] Field of Search ..... 235/61 NV, 78 N, 88 N, 235/116; 33/1 SD, 430–431, 465

[56] References Cited

U.S. PATENT DOCUMENTS

| | | | |
|---|---|---|---|
| 3,721,007 | 3/1973 | Banner | 33/1 SD |
| 3,844,042 | 10/1974 | Hodge | 33/430 |
| 3,855,706 | 12/1974 | Price | 235/61 NV |

*Primary Examiner*—L. T. Hix
*Assistant Examiner*—Thomas H. Tarcza
*Attorney, Agent, or Firm*—Merriam, Marshall & Bicknell

[57] ABSTRACT

A navigational aid device comprising three concentrically mounted relatively moveable scales and at least one centrally mounted rotatable arm defining a moveable radial line intersecting the scales and their axis of rotation, at least the central portion of the device being transparent or cut-away so that when placed on a map the map location appearing on the axis is visible to an operator using the device.

5 Claims, 4 Drawing Figures

VARIATION WEST EAST VARIATION

NAVIGATIONAL AID

The present invention relates to navigation and particularly, but not exclusively to aerial navigation using radio navigational aids.

One of the most common radio navigation aids is the Automatic Direction Finder or ADF which, when tuned to a radio transmitting station will indicate the angular position of the signal source relative to the longitudinal axis of the aircraft. Once the true heading of the aircraft is known, simple addition or subtraction enables a radial line to be drawn from the known position of the radio source through the true position of the aircraft. A repetition of this procedure for another suitably spaced radio source will define two lines on the map which intersect at the true geographical position of the aircraft.

While the calculations involved are relatively simple and straightforward they require some degree of mental agility on the part of the pilot. At best they are time consuming and at worst distracting and susceptible to errors.

The present invention has been developed to provide a direct means of arriving at a true position without involving any mental or paper arithmetical calculations.

According to the invention there is provided a navigational aid device comprising three concentrically mounted relatively moveable scales and at least one centrally mounted rotatable arm defining a moveable radial line intersecting said scales and their axis of rotation, at least the central portion of said device being transparent or cut-away so that when placed on a map the map location appearing on said axis is visible to an operator using the device.

Preferred embodiments of the invention will now be described, by way of example only, with reference to the accompanying drawings in which.

Figures 1, 2, 3:
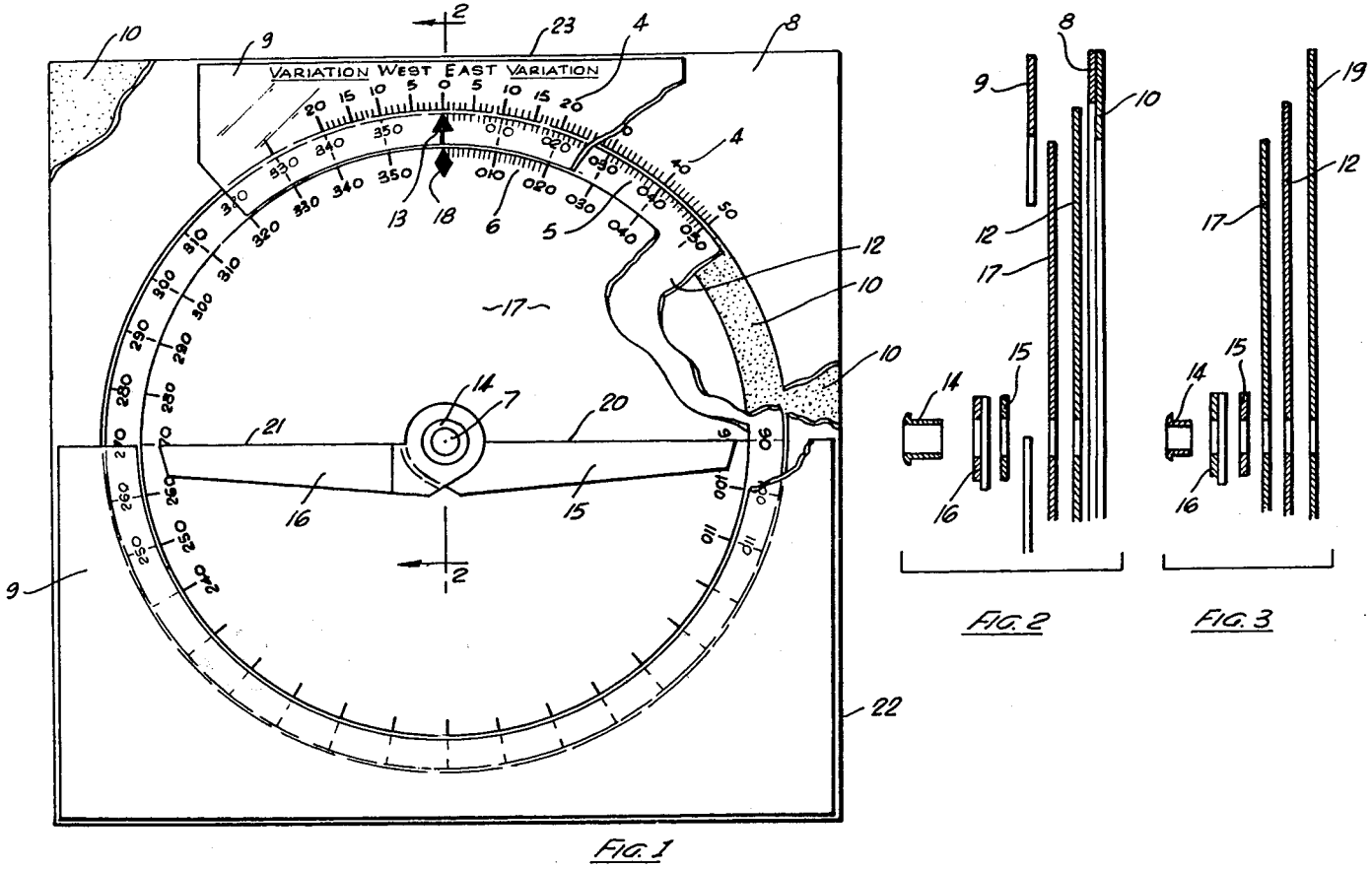
FIG. 1 is a partly cut-away plan view showing one embodiment of a navigational aid according to the invention.
FIG. 2 is an exploded section taken on line 2—2 of FIG. 1.
FIG. 3 is a section similar to FIG. 2 but showing an alternative embodiment of the invention.

Referring initially to FIGS. 1 and 2, the device includes three scales 4, 5 and 6 concentrically disposed and arranged to be relatively moveable about a central axis 7. The three scales are respectively for Magnetic Variation, Magnetic Heading and ADF or Relative Bearing.

The Magnetic Variation scale 4 extends from zero to 180° on either side of a zero position and around the periphery of an intermediate sheet 8 sandwiched between cover strips 9 and a rectangular backing sheet 10.

The backing sheet 10, intermediate sheet 8 and cover strips 9 support a captive disc 12 for relative rotation about the axis 7. The Magnetic Heading scale 5 is inscribed around the periphery of the disc 12 and is calibrated from an arrow-head zero pointer 13 through to 360°.

The disc 12 in turn supports a central rivet 14 which mounts two relatively rotatable arms 15 and 16 as well as a second disc 17. The periphery of this disc 17 is calibrated with the ADF scale 6 which extends from a diamond zero pointer 18 through to 360° as shown.

Figure 4:
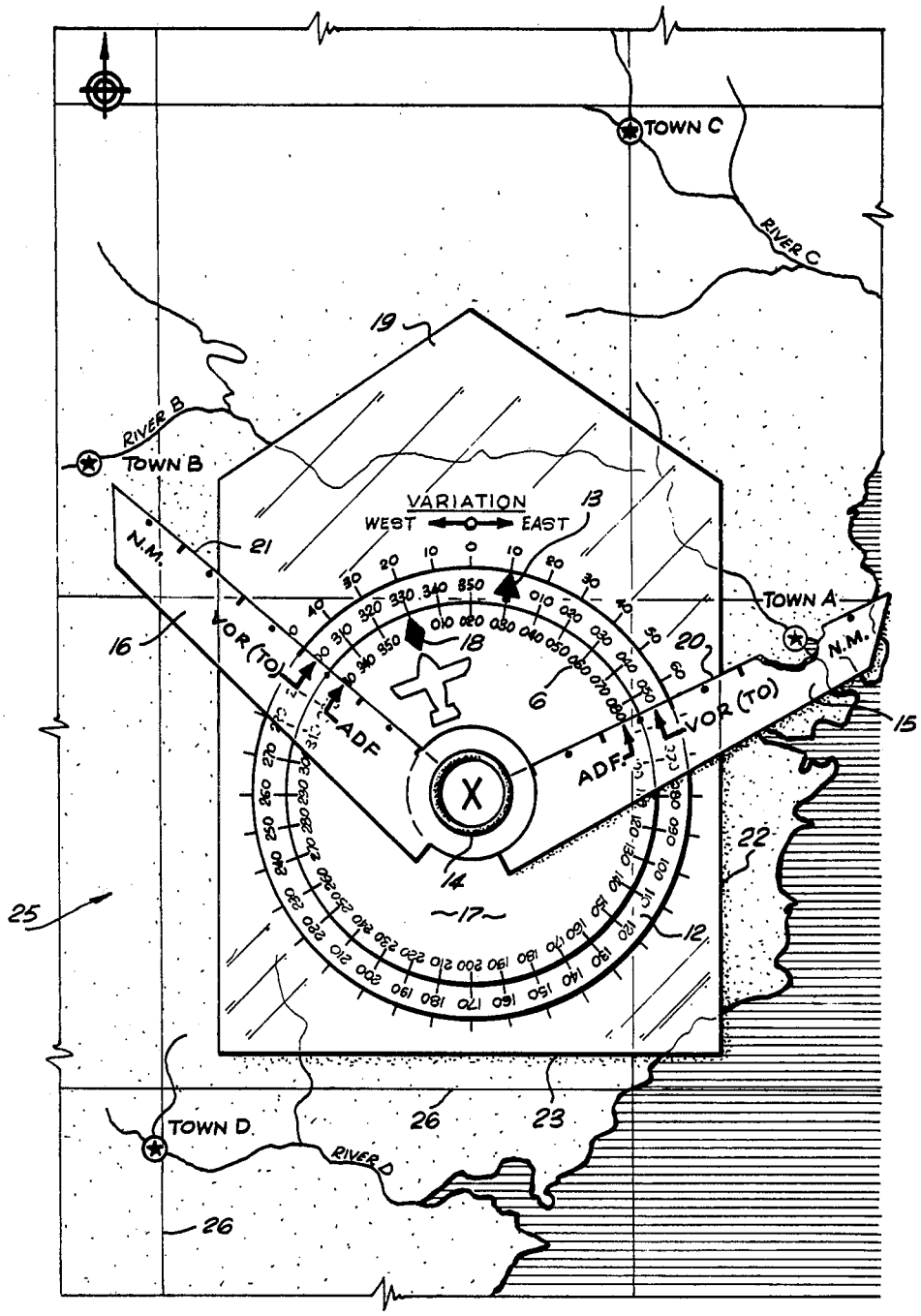
FIG. 4 is a plan view of another embodiment of the invention showing the navigational aid in operative position on a map.

In the simplified embodiment shown in FIG. 3, the Magnetic Variation scale is inscribed on a single rectangular sheet 19 which replaces the three components 8, 9 and 10 of the previous embodiment, the remaining components being identical. The embodiment illustrated in FIG. 4 is essentially identical to that shown in section in FIG. 3 and the same reference numerals have been used to identify corresponding components. In this case, however, the arms 15 and 16 extend beyond the sheet 19 which has been reduced to facilitate handling and storing the device. In each case, all components are preferably constructed of a transparent plastics material.

The operation of the navigational aid is straightforward and easily mastered. In the example illustrated in FIG. 4, the Magnetic Variation is assumed to be 10° EAST; the Magnetic Heading 330° Magnetic; and the ADF readings from radio beacons at Towns A and B 085° and 330° respectively. The object is to locate the true position X of the aircraft on the map 25.

While Magnetic Variation is by no means constant it is generally known to a sufficient degree of accuracy for any general area in which a pilot may find himself. The navigational determination can, therefore, be initiated by rotating the disc 12 until the arrow-head pointer 13 is opposite the correct calibration mark of 10° EAST on the Magnetic Variation scale 4.

The operator then ascertains the Magnetic Heading of the aircraft as determined, for example, by a compass or directional giro and rotates the disc 17 until the diamond pointer 18 is opposite the correct calibration mark of 330° M on the Magnetic Heading scale 5. It will be appreciated that the angular position indicated by the diamond on the Magnetic Variation scale 4 is in fact the true heading of the aircraft.

The operator then selects a known radio source (Town A) and notes the bearing (085°) determined by the ADF receiver. One of the arms 15 is then rotated until its radial edge 20 is aligned on the ADF scale 6 with the indicated ADF bearing 085° to the known radio source. A second and appropriately spaced radio source (Town B) is then selected and the other arm 16 positioned so that its radial edge 21 is aligned on the ADF scale with the indicated bearing 330° to the second known station. The invention is equally applicable to other radio navigational aids such as the VOR. If a VOR receiver is used to read the Magnetic Heading to a known station, the edges are aligned with the Magnetic Heading scale 5 rather than the ADF or relative bearing scale 6. Thus if Town A had a VOR station, the VOR receiver would indicate 055° to Town A and the arm 15 would be positioned precisely as determined above and shown in FIG. 4.

The navigational aid is then fully set to indicate the true position of the aircraft. This is determined by placing the device on the navigational chart with the rectangular edges 22 and 23 of the backing plate 19 always maintained in alignment with the grid lines 26. If the backing plate is not rectilinear, preferably at least two rectilinear datum lines are inscribed on it. In this configuration, the device is then moved over the map until the lines defined by edges 20 and 21 pass through their respective radio stations, Towns A and B respectively. The intersection of these two lines, namely the centre of the device, then determines the true position "X" of the aircraft. Preferably, the central rivet 14 is hollow to enable a pencil mark to be placed on the chart. In either case, the straight edge or edges may desirably be calibrated in nautical miles as shown, or concentric distance circles inscribed on the device. In the illustrated example, the central rivet is shown somewhat enlarged for clarity.

While it is preferable to have two arms 15 and 16, the device can be successively operated with one arm. In this case, when the arm has been correctly positioned for the first radio source, a line can be drawn onto the surface of the disc 17 and the single arm then used to define the true heading to the second station.

It will be readily apparent that the device may be used for many different types of navigational computations. For example, the distance and direction from the fix point "X" to any preselected destination such as Towns C or D can be readily determined by simple manipulation. Similarly, the distance and direction from a preselected location to the fix point can be equally readily determined. In such cases the Magnetic Variation pointer is set to zero and true directions read from the Magnetic Heading scale.

Although the invention has been described with reference to specific examples, it will be appreciated by those skilled in the art that the invention may be embodied in many other forms.

I claim:

1. A navigational aid device comprising first, second and third progressively overlaying sheets of material, said sheets being relatively rotatable about a common axis and being respectively inscribed with first, second and third scales, said first scale being indicative of magnetic variation, said second scale being indicative of magnetic heading and said third scale being indicative of relative bearing, at least said second and third sheets being in the form of concentrically mounted discs, said third sheet being of a lessor diameter than said second sheet, said device further including two centrally mounted independently operable rotatable arms defining two movable radial lines intersecting said scales and *said axis, said axis being defined by centrally located* pivot means securing said sheets and arms together for rotation about said axis, said pivot means having a central aperture such that when said device is placed on a map the map location appearing on said axis is visible through said aperture to an operator using said device, said aperture permitting said operator to place a mark directly onto said map location through said aperture whilst said device remains in position on said map.

2. A navigational aid according to claim 1 wherein said first sheet is at least partly rectilinear having at least two rectangular edges, one of said edges being parallel to a line from said axis to the zero point on said magnetic variation scale.

3. A navigational aid according to claim 1 wherein all said sheets are transparent substantially over their entire area.

4. A navigational aid according to claim 1 wherein said pivot means comprises a hollow rivet.

5. A navigational aid according to claim 1 wherein said arms are radially calibrated in units of distance.

* * * * *